US008077885B2

(12) United States Patent
Chang

(10) Patent No.: US 8,077,885 B2
(45) Date of Patent: Dec. 13, 2011

(54) MICROPHONE DEVICE

(75) Inventor: Jen-Tsorng Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 401 days.

(21) Appl. No.: 12/501,565

(22) Filed: Jul. 13, 2009

(65) Prior Publication Data

US 2010/0034413 A1 Feb. 11, 2010

(30) Foreign Application Priority Data

Aug. 8, 2008 (CN) ..... 2008 1 0303590

(51) Int. Cl.
*H04R 25/00* (2006.01)

(52) U.S. Cl. ..... 381/172; 381/355

(58) Field of Classification Search ..... 381/355, 381/369, 170, 171, 172; 398/132, 133, 134
See application file for complete search history.

(56) References Cited

U.S. PATENT DOCUMENTS 4,422,182 A * 12/1983 Kenjyo ..... 398/132
5,262,884 A * 11/1993 Buchholz ..... 398/134
5,621,806 A * 4/1997 Page et al. ..... 381/172

* cited by examiner

*Primary Examiner* — Huyen D Le
(74) *Attorney, Agent, or Firm* — Altis Law Group, Inc.

(57) ABSTRACT

A microphone device includes an enclosure, a nontransparent supporter, a light source, an annular-shaped optical sensor, a lens and a vibrating membrane. The enclosure has a bottom portion and a sidewall extending from the bottom portion. An opening is defined in the enclosure and opposite to the bottom portion. A nontransparent supporter is enclosed in the enclosure and positioned on the bottom portion. A passage is defined in the supporter, and has a first aperture and a second aperture at two opposite ends. The first aperture is adjacent to the bottom portion. The light source is positioned on the bottom portion, received in the passage and adjacent to the first aperture. The optical sensor is positioned on the supporter. The lens is received in the optical sensor and positioned on the supporter and covers the second aperture. The vibrating membrane is supported on the sidewall.

11 Claims, 3 Drawing Sheets

MICROPHONE DEVICE

BACKGROUND

1. Technical Field

The disclosure relates to a microphone device.

2. Description of Related Art

Currently, various microphones are used in many applications, such as telephones, tape recorders and cell phones, for example.

A typical microphone device includes a light emitting unit, a light receiving unit and a vibrating membrane. The light emitting unit emits light beams to the vibrating membrane, and then the vibrating membrane reflects the light beams to the light receiving unit. When affected by a sound wave, the vibrating membrane moves back and forth in response to the sound wave to vary incident angles of the light beams, such that the amount of light beams collected by the light receiving unit varies correspondingly. The light receiving unit generates an electrical signal via detecting the varying of the amount of collected light beams. Finally, the electrical signal is processed and converted into an audio signal. In order to prevent the light beams from being transmitted to the light receiving unit directly, a nontransparent plate is positioned between the light emitting unit and the light receiving unit, however, such structure complicates the structure of the typical microphone device.

Therefore, a new microphone device is desired to overcome the above-described shortcoming.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE EMBODIMENTS

Figure 1:
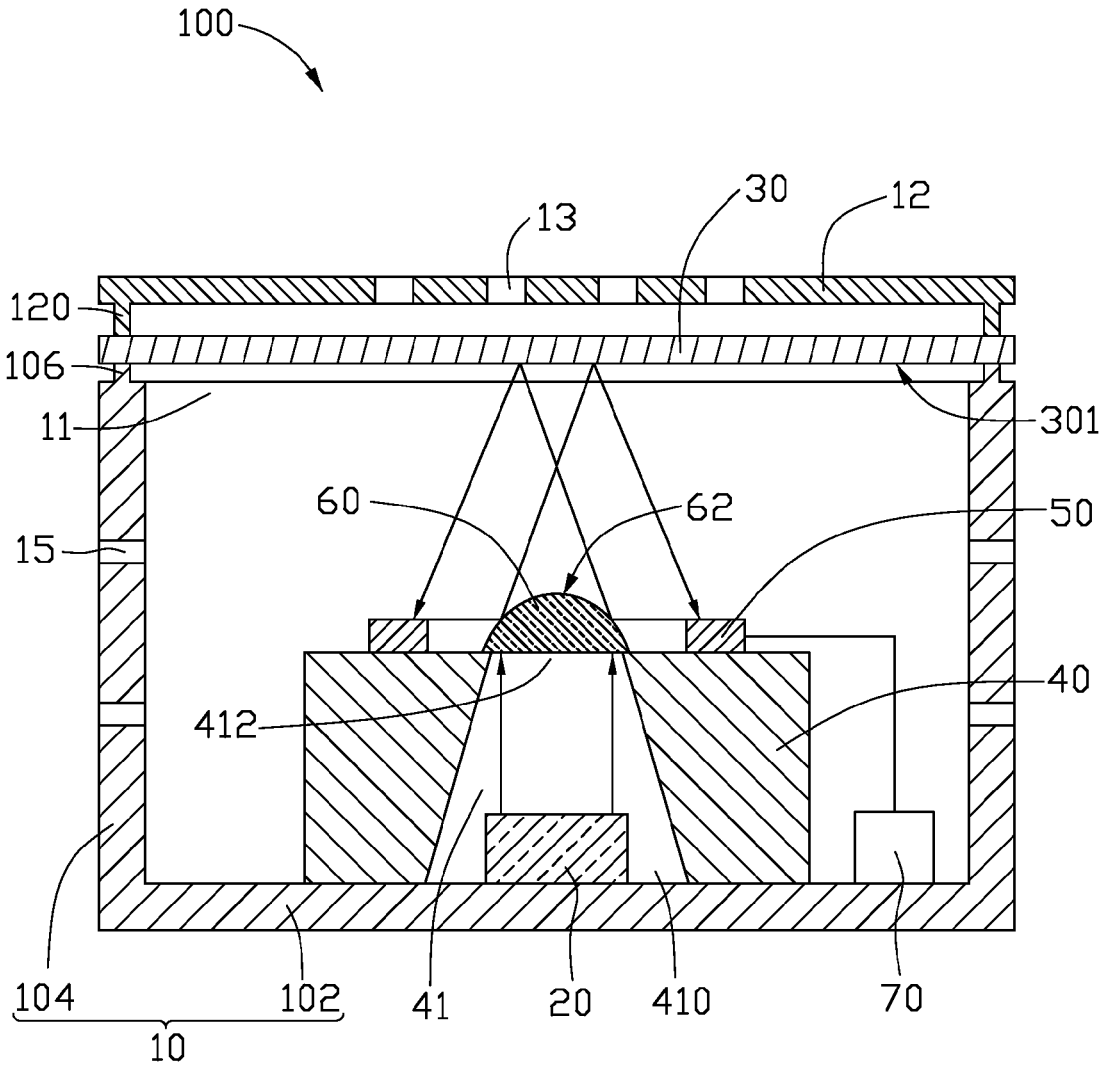
FIG. 1 is a cross-sectional view of one embodiment of a microphone device, the microphone device including a cover and a vibrating membrane.
Figure 2:
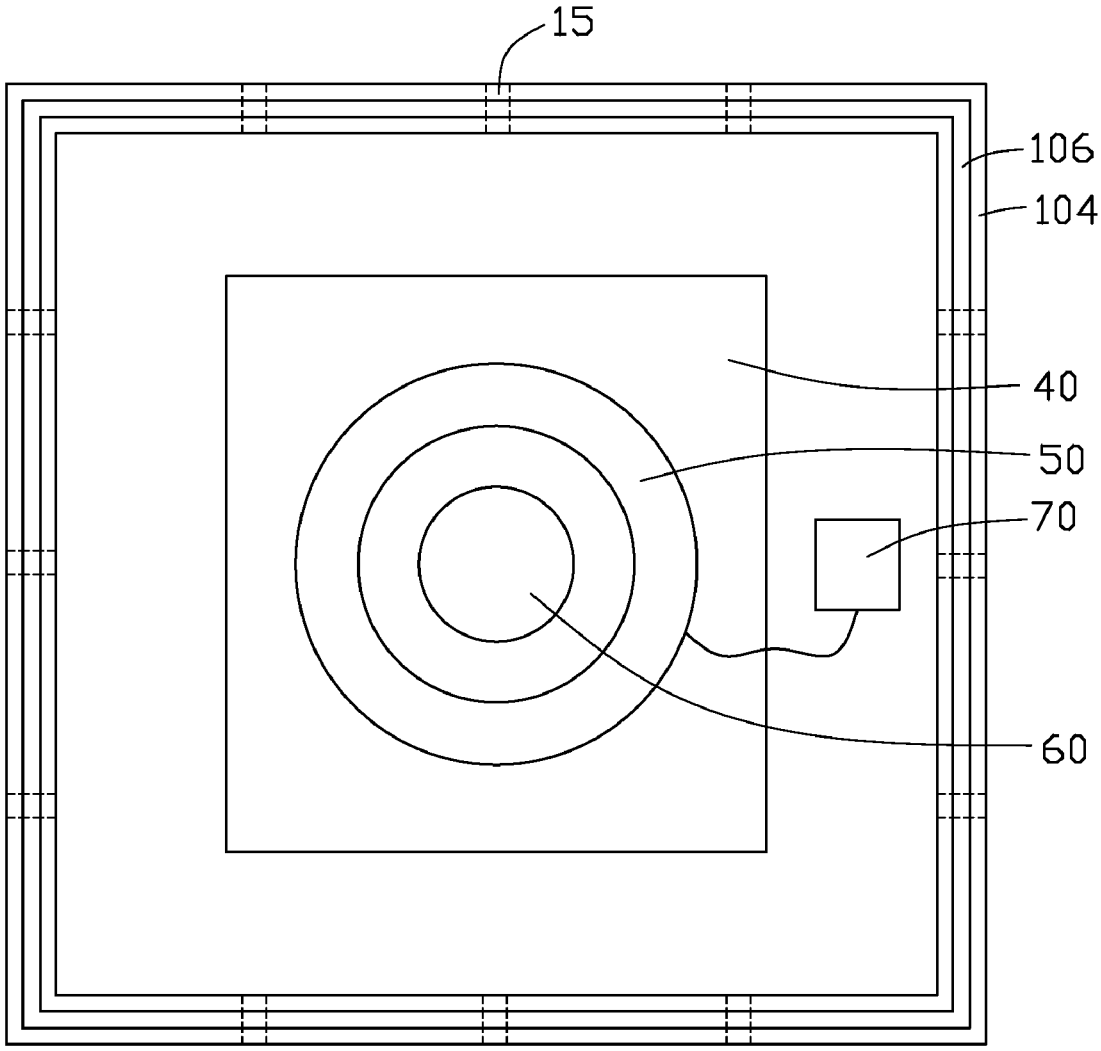
FIG. 2 is a perspective view of the microphone device of FIG. 1, the cover and the vibrating membrane being removed.

Referring to FIGS. 1 and 2, one embodiment of a microphone device 100 includes an enclosure 10, a cover 12, a light source 20, a vibrating membrane 30, a supporter 40, an optical sensor 50, a lens 60 and a processing unit 70.

The enclosure 10 has a bottom portion 102 and a sidewall 104 extending from the bottom portion 102. An opening 11 is defined in the enclosure 10 and opposite to the bottom portion 102. A plurality of through holes 15 is defined in the sidewall 104 and configured to balance sound pressure. A protrusion 106 extends from a topmost portion of the sidewall 104. The enclosure 10 may be rectangular-shaped or cylindrical-shaped. In the illustrated embodiment, the enclosure 10 is substantially rectangular-shaped.

The supporter 40 is enclosed in the enclosure 10 and positioned on the bottom portion 102. The supporter 40 is comprised of a nontransparent material. A frustoconical-shaped passage 41 is defined in a center portion of the supporter 40. The passage 41 has a wide aperture 410 and a narrow aperture 412 at two opposite ends. The wide aperture 410 is adjacent to the bottom portion 102. The supporter 40 may be rectangular-shaped or cylindrical-shaped. In the illustrated embodiment, the supporter 40 is substantially rectangular-shaped.

The light source 20 is secured on the bottom portion 102 and received in the passage 41. The light source 20 is configured to emit light beams to the lens 60. The light source 20 may include a light emitting diode or a laser. In the illustrated embodiment, the light source 20 includes a laser.

The optical sensor 50 is positioned on the supporter 40 and adjacent to the narrower aperture 412. The optical sensor 50 is substantially annular-shaped and has an inner diameter greater than a diameter of the narrower aperture 412.

The lens 60 is partially received in the optical sensor 50 and positioned on the supporter 40 to cover the narrower aperture 412. The lens 60 is substantially semi-spherical-shaped, and coaxial with the optical sensor 50 and the passage 41. The lens 60 has a convex surface 62 configured to diverge the light beams to the vibrating membrane 30. A diameter of the lens 60 is smaller than the inner diameter of the optical sensor 50 and slightly greater than a diameter of the narrower aperture 412.

A peripheral portion of the vibrating membrane 30 contacts the protrusion 106, such that the vibrating membrane 30 is supported on the sidewall 104 and covers the opening 11. The vibrating membrane 30 further defines a reflective surface 301 facing the convex surface 62 and the optical sensor 60. The reflective surface 301 is configured to reflect light beams refracted and diverged by the convex surface 62 to the optical sensor 50.

Figure 3:
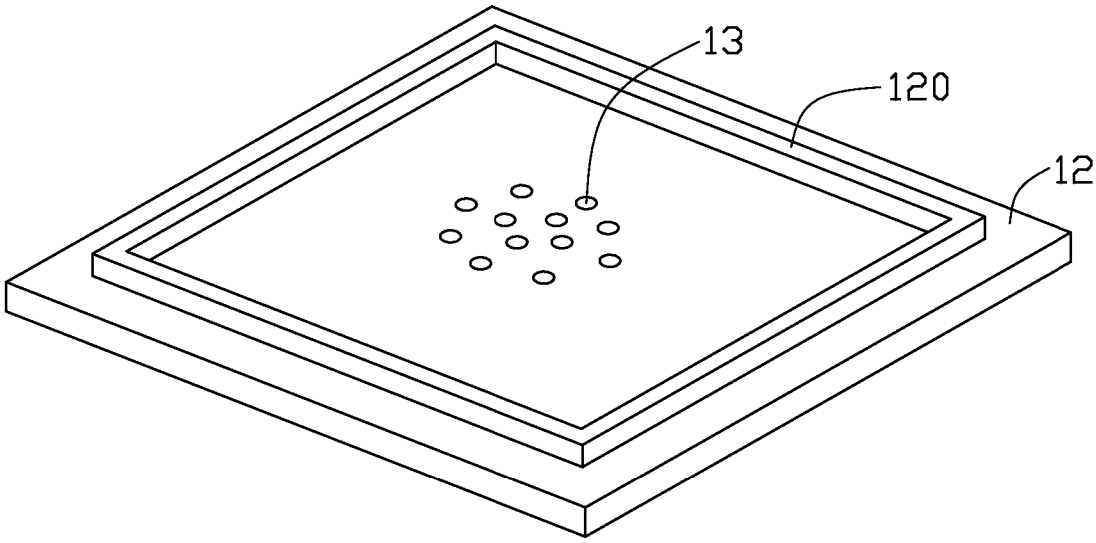
FIG. 3 is a perspective view of the cover.

Also referring to FIG. 3, a projecting portion 120 extends from a peripheral portion of the cover 12. The peripheral portion of the vibrating membrane 30 is clipped between the projecting portion 120 and the protrusion 106, such that the vibrating membrane 30 can seal the opening 11. A plurality of sound holes 13 is defined in the central portion of the cover 12 and configured to allow a sound wave to pass through.

The processing unit 70 is positioned in the enclosure 10 and electrically coupled to the optical sensor 50. The processing unit 70 may be a digital signal processing unit.

In use, the light source 20 emits light beams to the lens 60. The light beams transmit through the lens 60, and then are refracted and diverged by the convex surface 62 to the reflective surface 301. Diverged light beams are reflected by the reflective surface 301 to the optical sensor 60. When a sound wave passes through the sound holes 13 and acts on the vibrating membrane 30, the vibrating membrane 30 vibrates in response to the sound wave such that incident angles of the diverged light beams vary. As a result, the amount of light beams collected by the optical sensor 50 varies in response to the vibrating of the vibrating membrane 30. The optical sensor 50 detects the varying of the amount of the collected light beams to generate a corresponding electrical signal. The electrical signal is delivered to the processing unit 70, and converted by the processing unit 70 into an audio signal.

The nontransparent supporter 40 is applied to block light beams emitted from the light source 20 from transmitting to the optical sensor 50 directly, allowing the microphone device 10 to have a compact structure.

It is believed that the present embodiments and their advantages will be understood from the foregoing description, and it will be apparent that various changes may be made thereto without departing from the spirit and scope of the embodiments or sacrificing all of its material advantage.

What is claimed is:

1. A microphone device, comprising:

an enclosure having a bottom portion and a sidewall extending from the bottom portion, an opening being defined in the enclosure and opposite to the bottom portion;

a nontransparent supporter enclosed in the enclosure and positioned on the bottom portion, a passage being defined in the supporter and having a first aperture and a second aperture at two opposite ends thereof, the first aperture being adjacent to the bottom portion;

a light source positioned on the bottom portion, received in the passage and adjacent to the first aperture;

an annular-shaped optical sensor positioned on the supporter and adjacent to the second aperture;

a lens received in the optical sensor, positioned on the supporter and covering the second aperture; and a vibrating membrane having a peripheral portion and a reflective surface, the peripheral portion being supported on the sidewall such that the vibrating membrane seals the opening, the reflective surface being opposite to the lens and the optical sensor.

2. The microphone device of claim 1, further comprising a cover covering the vibrating membrane and defining a plurality of sound holes therein.

3. The microphone device of claim 2, wherein a protrusion is positioned on a topmost portion of the sidewall, a projecting portion is positioned on a peripheral portion of the cover, and the vibrating membrane is clipped between the protrusion and the projecting portion.

4. The microphone device of claim 1, wherein the lens is substantially semi-spherical-shaped and has a convex surface opposite to the reflective surface.

5. The microphone device of claim 4, wherein the lens is substantially coaxial with the optical sensor and the passage.

6. The microphone device of claim 1, wherein the passage is frustoconical-shaped, the first aperture is a wider aperture, and the second aperture is a narrower aperture.

7. The microphone device of claim 1, wherein a plurality of through holes is defined in the sidewall and configured to balance sound pressure.

8. The microphone device of claim 1, further comprising a processing unit electrically coupled to the optical sensor.

9. The microphone device of claim 8, wherein the processing unit is a digital signal processing unit.

10. The microphone device of claim 1, wherein the supporter is substantially rectangular-shaped.

11. The microphone device of claim 1, wherein the enclosure is substantially rectangular-shaped.

* * * * *